US011549273B2

(12) United States Patent
Jablonsky

(10) Patent No.: US 11,549,273 B2
(45) Date of Patent: Jan. 10, 2023

(54) LIFT ANCHOR FOR PRECAST CONCRETE COMPONENT

(71) Applicant: ALP Supply, Inc., Fairless Hills, PA (US)

(72) Inventor: David S. Jablonsky, Washington Crossing, PA (US)

(73) Assignee: ALP Supply, Inc., Fairless Hills, PA (US)

( * ) Notice: Subject to any disclaimer, the term of this patent is extended or adjusted under 35 U.S.C. 154(b) by 0 days.

(21) Appl. No.: 16/042,377

(22) Filed: Jul. 23, 2018

(65) Prior Publication Data

US 2019/0048601 A1 Feb. 14, 2019

Related U.S. Application Data

(60) Provisional application No. 62/543,441, filed on Aug. 10, 2017.

(51) Int. Cl.
*E04B 9/00* (2006.01)
*E04G 21/14* (2006.01)
*E04B 1/41* (2006.01)

(52) U.S. Cl.
CPC ..... *E04G 21/142* (2013.01); *E04B 1/4157* (2013.01)

(58) Field of Classification Search
CPC ..... E04G 21/142; E04B 1/4157
USPC ..... 52/125.4, 125.3, 125.2, 853
See application file for complete search history.

(56) References Cited

U.S. PATENT DOCUMENTS 1,045,587 A * 11/1912 Morley ..... B29C 45/14073 156/303.1
1,778,925 A * 10/1930 Thornley ..... E02D 5/385 405/253
2,137,718 A * 11/1938 Friberg ..... E04C 5/03 29/452
2,344,206 A * 3/1944 Forni ..... B28B 23/005 110/339
2,794,336 A 6/1957 Ballou
2,962,839 A * 12/1960 Carlson ..... E04B 5/043 52/125.4
3,375,795 A * 4/1968 Merkle, Jr. ..... F27D 1/021 110/331
3,436,890 A * 4/1969 Dismukes ..... D21J 3/00 52/660
3,534,668 A * 10/1970 Scheinoha ..... E01C 5/08 404/45

(Continued)

FOREIGN PATENT DOCUMENTS

DE 29914235 U1 11/1999
EP 3029220 A1 6/2016
FR 2184303 A5 12/1973

*Primary Examiner* — Basil S Katcheves
(74) *Attorney, Agent, or Firm* — Timothy J. Monahan; Monahan & Company, LLC

(57) ABSTRACT

A precast concrete component is provided with anchor having a cylindrical rod bent to form a centrally-positioned handle and two downwardly extending legs. The handle can be relatively smooth and die legs are provided with a series of projections along their lengths, such as are formed by threads. The legs of the anchor may converge inwardly from the handle and are compatible with precast concrete double tees having webs or stems that taper from the flange of the double tee downward. Alternatively, the legs of the anchor may diverge outwardly from the handle.

20 Claims, 11 Drawing Sheets

(56) References Cited

U.S. PATENT DOCUMENTS 3,626,648 A * 12/1971 Beckham ..... E01D 21/00 52/127.3
3,705,469 A * 12/1972 Eriksson ..... B28B 23/005 249/66.1
3,916,590 A * 11/1975 Miller ..... E04H 13/00 52/124.2
3,977,344 A * 8/1976 Holford ..... B63B 35/38 114/263
4,074,499 A * 2/1978 Mess ..... E04B 1/4121 52/705
4,262,951 A * 4/1981 Hoyer ..... B66C 1/666 294/82.1
4,443,980 A * 4/1984 Pennypacker ..... E04G 15/04 52/125.4
4,531,861 A 7/1985 Kash
4,563,110 A * 1/1986 Langenbach, Jr. ..... E04G 23/0203 405/230
4,615,554 A * 10/1986 Schilla ..... E04G 21/142 294/89
4,634,164 A * 1/1987 Fricker ..... B66C 1/666 294/82.24
4,702,045 A * 10/1987 Fricker ..... E04G 21/142 52/125.4
5,004,208 A * 4/1991 Domizio ..... E04G 15/04 249/177
5,050,364 A * 9/1991 Johnson ..... E04B 1/4157 52/295
5,226,265 A * 7/1993 Kelly ..... E04G 21/142 294/82.35
5,402,609 A * 4/1995 Kelley, Jr. ..... B28B 7/183 52/122.1
5,596,846 A 1/1997 Kelly
5,651,642 A * 7/1997 Kelley, Jr ..... E02D 29/025 405/284
5,732,991 A * 3/1998 Tsui ..... B66C 1/66 294/215
6,401,406 B1 * 6/2002 Komara ..... E04B 1/4157 52/127.3
6,848,864 B1 * 2/2005 Davie, Jr. ..... E02D 27/48 405/230
7,111,432 B2 9/2006 Hansort
7,665,941 B2 * 2/2010 Wolf ..... E04C 5/161 411/431
D645,731 S * 9/2011 Williams ..... D8/370
8,381,482 B2 * 2/2013 Lin ..... E04B 1/4157 52/295
8,397,464 B2 * 3/2013 Lin ..... E04B 1/4157 52/701
8,695,287 B1 * 4/2014 Francies, III ..... E04G 21/142 52/125.4
8,898,964 B1 12/2014 Francies, III
9,097,001 B2 * 8/2015 Espinosa ..... E04C 5/125
9,151,065 B1 10/2015 Francies, III
2002/0083658 A1 * 7/2002 Dial, Jr. ..... B22C 9/24 52/125.4
2003/0140576 A1 * 7/2003 Sanftleben ..... E04G 15/04 52/125.4
2005/0044811 A1 3/2005 Hansort
2005/0055956 A1 3/2005 Hardy
2007/0059102 A1 * 3/2007 Beach ..... E01D 4/00 405/125
2008/0196324 A1 8/2008 Mackay Sim
2009/0320386 A1 * 12/2009 Mackay Sim ..... B28B 7/002 52/125.4
2010/0000175 A1 * 1/2010 Johnson ..... B28B 23/0056 52/704
2010/0058677 A1 * 3/2010 Arteon ..... E04G 21/142 52/122.1
2012/0304554 A1 * 12/2012 Sladojevic ..... B66C 1/666 52/125.4
2018/0058081 A1 3/2018 Hansort

* cited by examiner

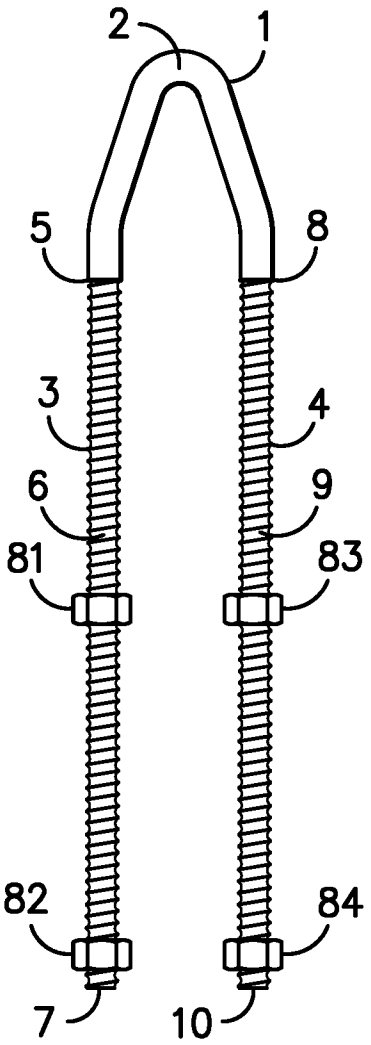
FIG. -10-
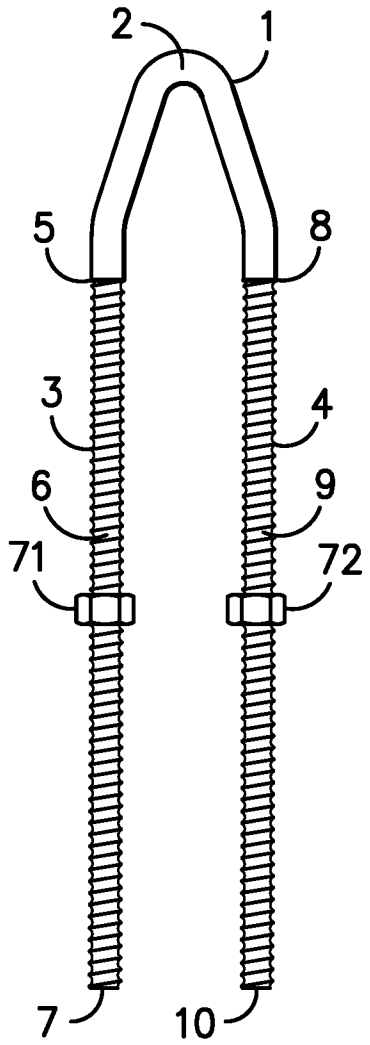
FIG. -11-
FIG. -12-

LIFT ANCHOR FOR PRECAST CONCRETE COMPONENT

The present invention relates to anchors that are embedded in a precast concrete component, such as a double tee, to facilitate lifting the component.

BACKGROUND OF THE INVENTION

Many buildings, parking garages, highway overpasses and other structures are assembled from precast concrete components. The components are typically manufactured at a first location and then transported to the construction site. To facilitate transportation and assembly, the precast concrete components are provided with anchors embedded in the concrete, which can be engaged by heavy equipment, such as cranes, to lift the components.

The precast concrete component may be a three-dimensional structure, such as a double tee used for roofs, parking decks and bridge overpasses. Various reinforcement materials may be incorporated in the precast concrete, such as rebar, welded wire, and multi-ply cables, which may be pre-stressed or post-tensioned. Any anchor system must be compatible with the reinforcement material incorporated into the concrete.

Lifting anchors having various features embedded in the concrete for resisting pull-out are shown in the following United States patents and published patent applications: Kelly—U.S. Pat. No. 5,596,846; Hansort—U.S. Pat. No. 7,111,432 B2; Hanson—US Patent Application Publication No. 2005/0044811 A1; Machay Sim—US Patent Application Publication No. 2008/0196324 A1; and Francies, III—U.S. Pat. No. 8,695,287 B1.

Despite the prior art developments, there remains a need for a lift anchor that is economical to manufacture, compatible with a range of reinforcement materials used in precast concrete, and adaptable for use with precast concrete components having relatively thin sections.

SUMMARY OF THE INVENTION

The present invention includes an anchor designed for lifting a precast concrete component and a precast concrete component incorporating the anchor.

The anchor is made from a rod which may be bent to form a centrally positioned handle and first and second downwardly extending legs. For example, the handle section of die anchor may have the shape of a sideways "C" or an inverted "U" or "V." Each of the legs may be characterized by a top end adjacent one side of the handle and a bottom end opposite the handle. The rod may have a cross section that is cylindrical, elliptical, or polygonal, such as triangular or rectangular.

Each of the legs is provided with a series of projections along its length. The projections are defined by a crest, representing the outermost distance from the center of the leg, also referred to as the major diameter, and a root or trough, representing die innermost distance from the center of the leg, also referred to as the minor diameter. The distance between the crest and the trough of a projection is referred to herein as the height of the projection. The distance between projections is the pitch.

The handle component of the anchor may be relatively smooth, that is, free of the projections that are provided on die legs, in particular, the underside of the handle may be free where it is in contact with the lifting tackle. Accordingly, when the anchor is employed to lift a precast concrete structure by engaging a hook or other lifting tackle with the handle, the hook or tackle may readily slide to the highest point of the anchor handle, thereby eliminating sudden shifts in the point of contact.

The projections are designed to increase the load bearing capacity of the lift anchor by distributing stress along the length of each of the legs, rather than concentrating the load bearing force at one location. Furthermore, the streamlined profile of the anchor of the present invention is particularly useful for relatively thin sections of precast concrete components. The pitch, height of the projections and angle of the sides of the projections relative to the axis of the legs are selected to allow the concrete to flow into the gaps between projections, thereby maximizing the strength of the material surrounding the anchor.

The projections may be a series of ridges provided in the outside surface of the legs. In one embodiment of the invention the legs are threaded, that is, the projection is a helical rib formed on the outside of the rod. The threads may be created along the length of each of the legs before the rod is bent into the shape of an anchor, i.e. while the rod is straight. For example, the threads may be rolled threads or they may be cut threads. By way of example, the threads may be coil threads, acme threads, Unified Coarse threads (UNC) or Unified Fine threads (UFC). The threadform may be square, triangular, trapezoidal, or other shape. Of particular interest are coil threads having a threadform characterized by a concave arc extending between adjacent crests, which allow wet concrete to fully penetrate to the minor diameter of the leg, thereby ensuring that the leg is locked in place when the concrete sets.

The use of threads as the projections along the legs of the anchor opens the possibility to provide one, two, three or more nuts threaded on to the anchor, to increase the pull-out strength. By way of example, multiple nuts may be spaced out along each of the legs. The nuts may be fixed in place to maintain their position on the legs, prior to insertion in concrete, with an adhesive, such as a hot-melt adhesive.

The legs of the anchor may be parallel. Alternatively, in one embodiment of the invention, the legs angle inward. For example, the distance between the top end of the first leg and the top end of the second leg is greater than the distance between the bottom end of the first leg and the bottom end of the second leg. In another embodiment of the invention, the legs of the anchor may angle outward. For example, the distance between the bottom end of the first leg and die bottom end of the second leg may be greater than the distance between the top end of the first leg and the top end of the second leg.

The handle of the anchor, as well as the first and second legs may be aligned in the same plane, or the legs may angle away from the plane defined by the handle, adjacent the top ends of the legs.

The anchor is embedded in a precast concrete component. In particular, the legs are embedded in die concrete with the handle accessible to a hook or other connector for lifting the component. The handle may extend above the outer surface of the precast concrete component. Alternatively, the handle may be recessed, that is, below the outer surface of the surrounding concrete, which may be readily accomplished by using a recess form, as is well-known in the art. The anchor is inserted in the concrete, before the concrete sets in the form. The precast concrete component may also incorporate rebar, welded wire, or multi-ply cables, which may be pre-stressed or post-tensioned. Depending upon the shape and weight of the component, one, two, three, four, or more anchors may be embedded in the concrete component. By way of example, a double tee component will typically have 4 or 8 anchors embedded therein.

In one embodiment of the invention, the precast concrete component has a flange portion, also referred to as a deck, and at least one web, also referred to as a stem, extending perpendicular to the flange, such as a double tee. The anchor may be inserted from the upper surface of the flange with the legs extending downward into the web. The web may taper as it extends from the flange. Accordingly, it is advantageous that the legs of the anchor angle inward, to provide sufficient concrete between the anchor legs and the outer surface of the concrete, to avoid causing a fracture to the concrete when the precast concrete component is lifted by the anchors.

BRIEF DESCRIPTION OF THE DRAWINGS

FIG. 10 is a side view of the anchor of FIG. 1 including a single nut positioned on the bottom of each leg.

FIG. 11 is a side view of the anchor of FIG. 1 including a single nut positioned at die middle of each leg.

FIG. 12 is a side view of the anchor of FIG. 1 including a multiple nuts spaced along the length of each leg.

DETAILED DESCRIPTION OF THE INVENTION

Without intending to limit the scope of the invention, the preferred embodiments and features are hereinafter set forth. All of the United States patents and published applications cited in the specification are incorporated herein by reference.

Figure 1:
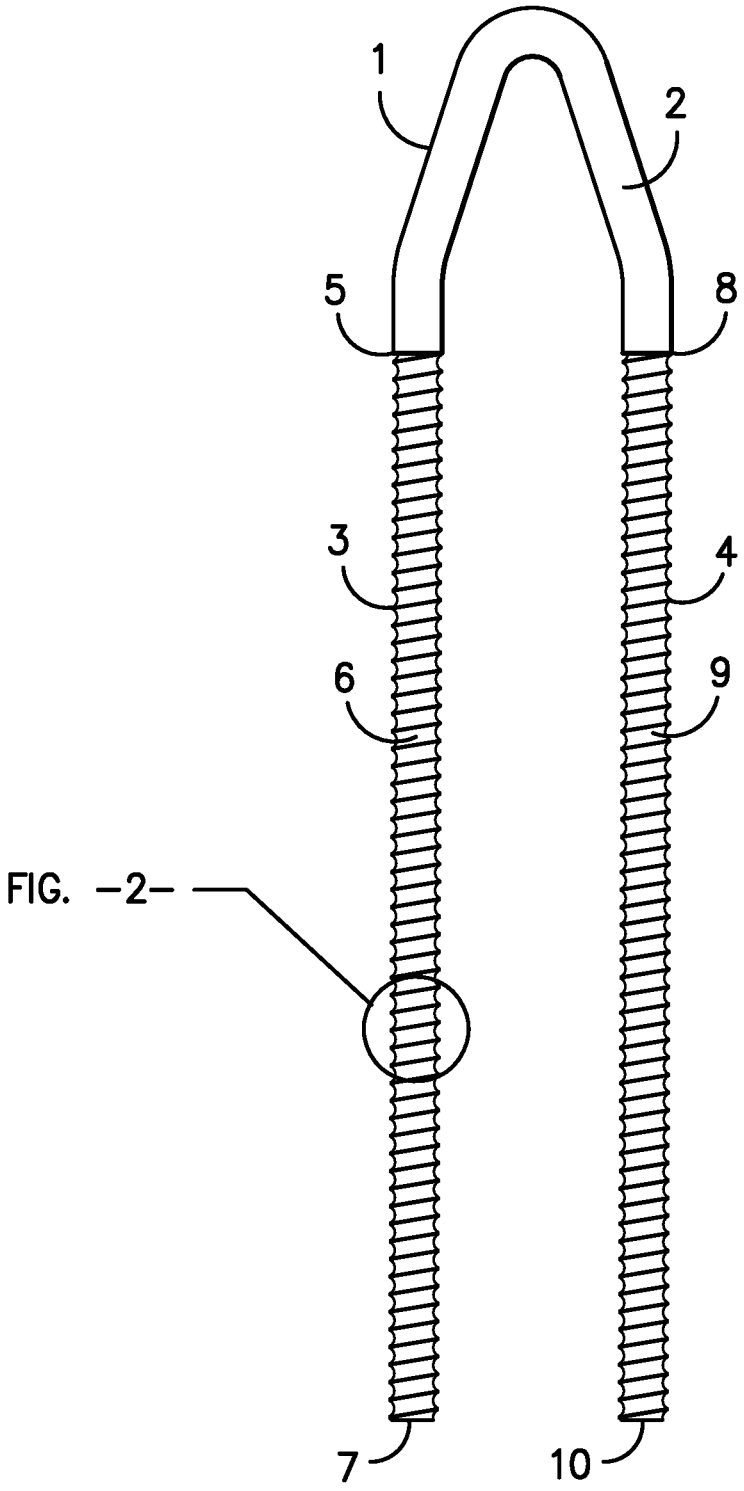
FIG. 1 is a front view of the anchor of die present invention.

Referring to FIG. 1, anchor 1 has an inverted "V" configuration, with handle 2 at the top and legs 3 and 4 extending downward. Legs 3 and 4 are substantially parallel. Leg 3 has top end 5, where handle 2 transitions into threads 6, and bottom end 7, opposite handle 2. Similarly, leg 4 has top end 8, where the opposite side of handle 2 transitions to threads 9, and bottom end 10.

Figure 2:
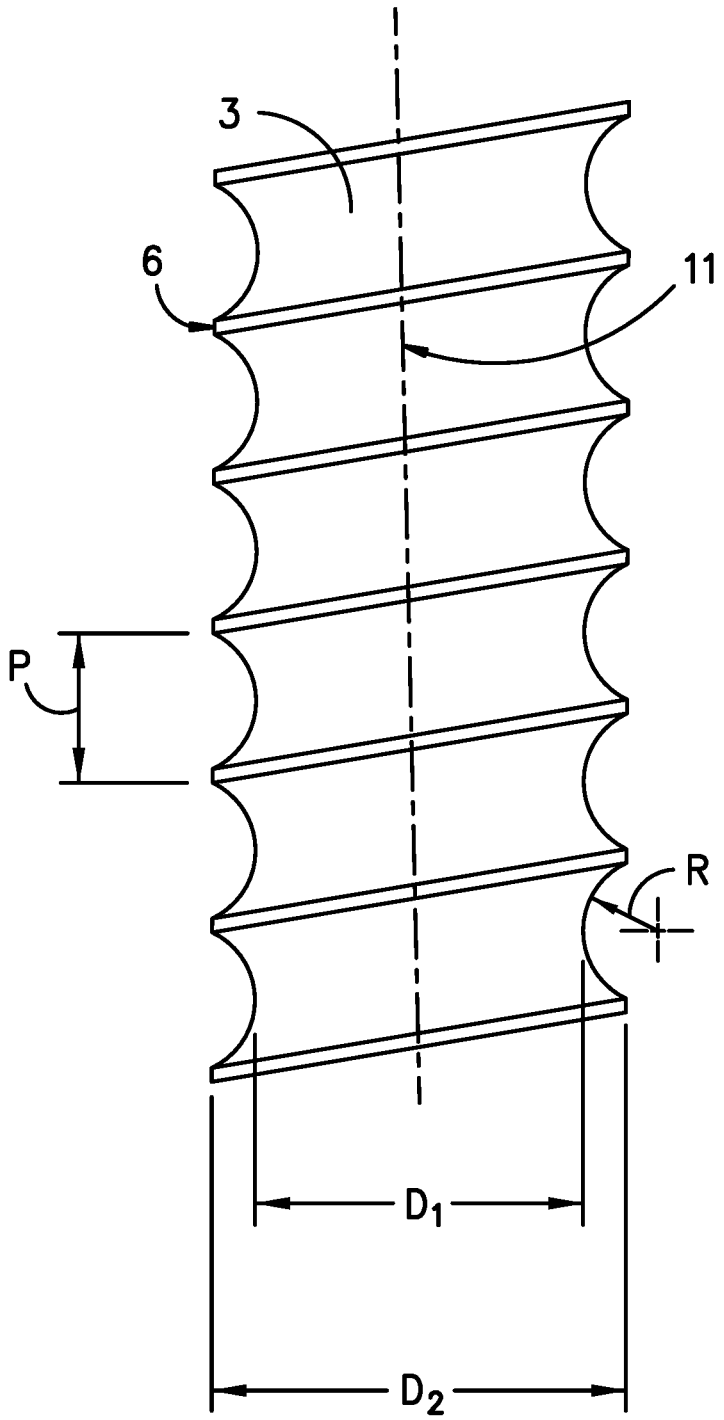
FIG. 2 is a magnified view of a section of a leg of the anchor shown in FIG. 1.

FIG. 2 shows a magnified view of a section of threads 6 of leg 3. Threads 6 may be coil threads and characterized by a pitch "P", the distance between the crests of the threads, a radius "R", the arc between adjacent crests of the threads of leg 3, and a major diameter $D_1$ and a minor diameter $D_2$ of the threads relative to the axis 11 of leg 3. By way of example, threads 6 and 9 of anchor 1 may have a pitch of from 3 mm to 100 mm, in particular from 7 mm to 30 mm, more particularly from 10 mm to 20 mm. The thread may have one, two, three or more starts. Radius R may range from 7 mm to 14 mm. By way of example, the threads or other series of projections along the legs of the lift anchor may be characterized by a major diameter and a minor diameter, in which the major diameter may be from 5% to 30% greater than the minor diameter. The depth of the threads or other projections may range from 1 mm to 10 mm, in particular from 1 mm to 3 mm, more particularly from 1.1 mm to 2 mm.

The overall length of anchor 1, as measured from the peak of handle 2 to the bottom ends of legs 3 and 4, will depend on die specific application, that is, the specification of the precast concrete component. For a typical double tee, the length will be approximately from 15 inches to 30 inches, but the overall dimensions of the anchor of the present invention is not limited. By way of example, each of the legs of the lift anchor may be provided with threads or other projections along a length of 6" or greater, 10" or greater, or even 15" or greater, depending on the requirements of supporting a particular precast concrete component.

Anchor 1 may be made from a rod having a circular cross section by providing threads at each end and bending the center of the rod to create handle 2. The threads can be rolled threads or cut threads, or the threads or other projections can be formed by casting or other manufacturing means. No specific shape for handle 2 is required, so long as it is possible to insert a hook or engage the handle with a lifting connector or other tackle. Handle 2 may be free from threads or any other projections, that is, handle 2 may be smooth.

Figure 3A:
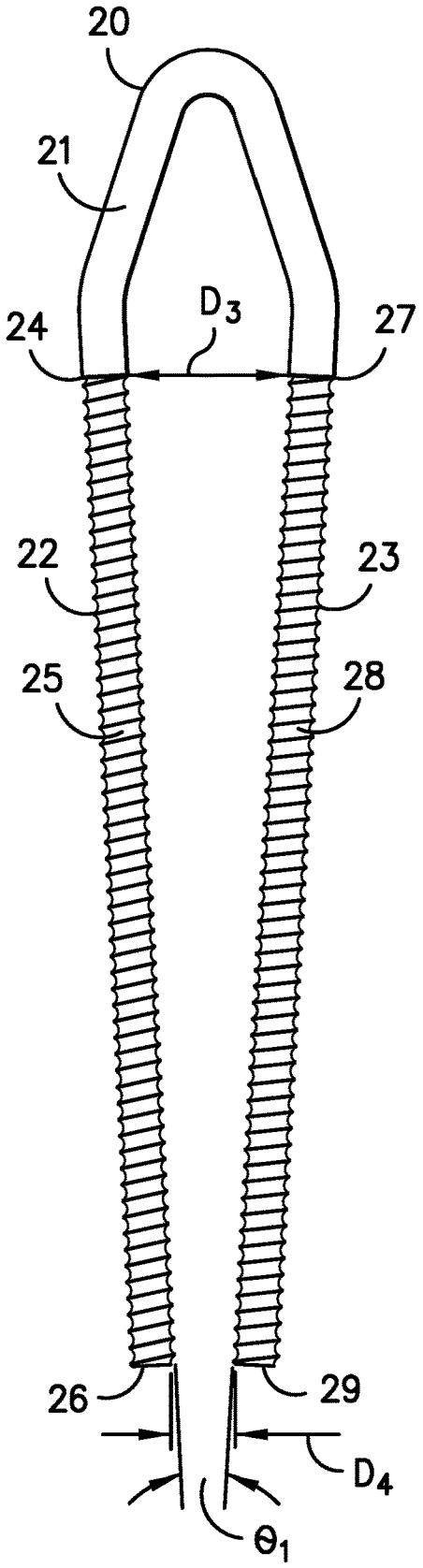
FIG. 3A is a front view of an embodiment of the anchor of the present invention having legs angled inward.
Figure 3B:
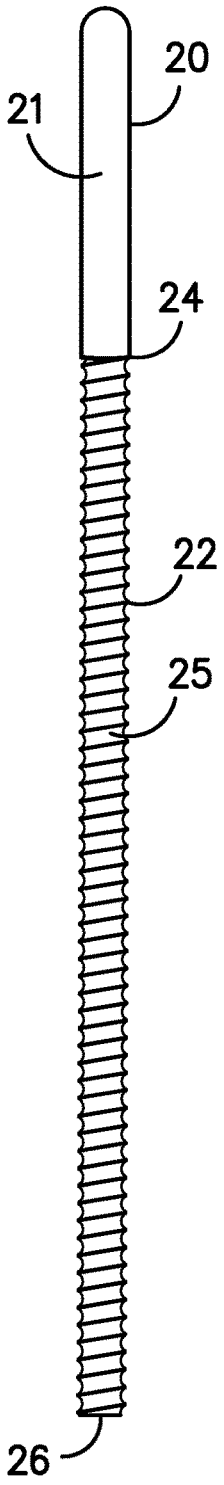
FIG. 3B is a side view of the anchor shown in FIG. 3A.

Referring to FIGS. 3A and 3B, an alternative embodiment of the anchor is shown, in which the legs converge, as they extend from the handle. Anchor 20 has handle 21 and legs 22 and 23 extending downward from handle 2. Leg 22 has top end 24, threads 25 and bottom end 26. Similarly, leg 23 has top end 27, threads 28 and bottom end 29. The threads may have the same features and parameters as those described with regard to anchor 1 of FIG. 1.

In one embodiment, the distance between the top end 24 of leg 22 and the top end 27 of leg 23, shown as $D_3$ in FIG. 3A, is greater than the distance between the bottom end of 26 of leg 22 and the bottom end 29 of leg 23, shown as $D_4$ in FIG. 3A. The distance $D_4$ may be 25% or less, 40% or less, or even 60% or less than the distance $D_3$.

Alternatively, the inward angle of legs 22 and 23 of anchor 20 may be characterized with reference to an angle $\Theta_1$ formed by the legs, as shown in FIG. 3A. By way of example, angle $\Theta_1$ may be greater than 0° and up to 60°, in particular from 1° and 45°, more particularly from 1° to 30°.

Figure 4A:
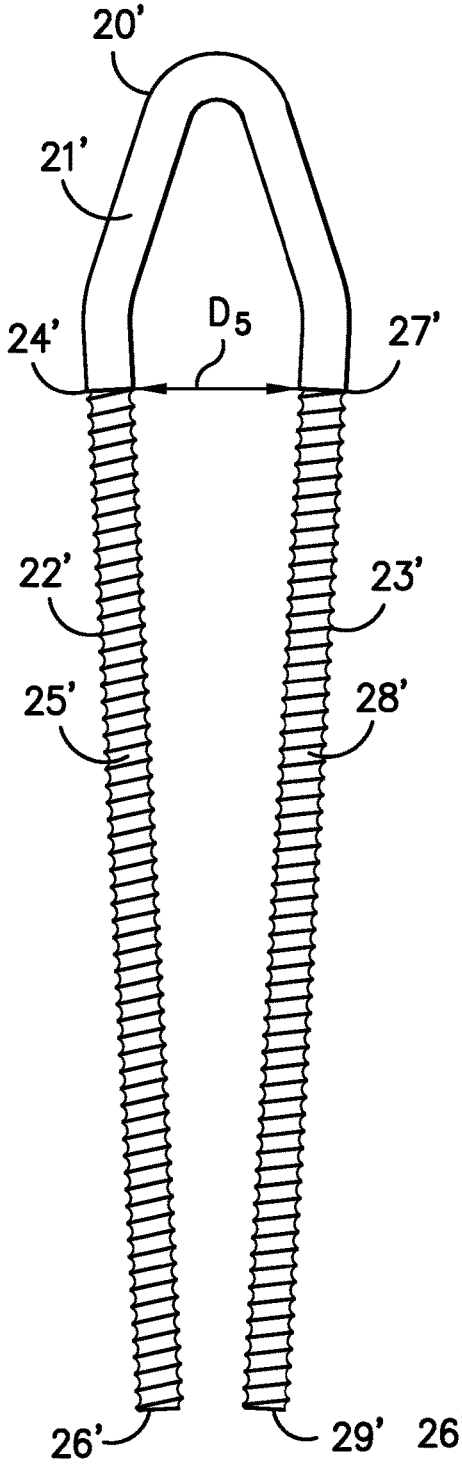
FIG. 4A is a front view of an embodiment of the anchor of the present invention having legs angled inward relative to a plane perpendicular to the handle and angled outward relative to a plane parallel to the handle.
Figure 4B:
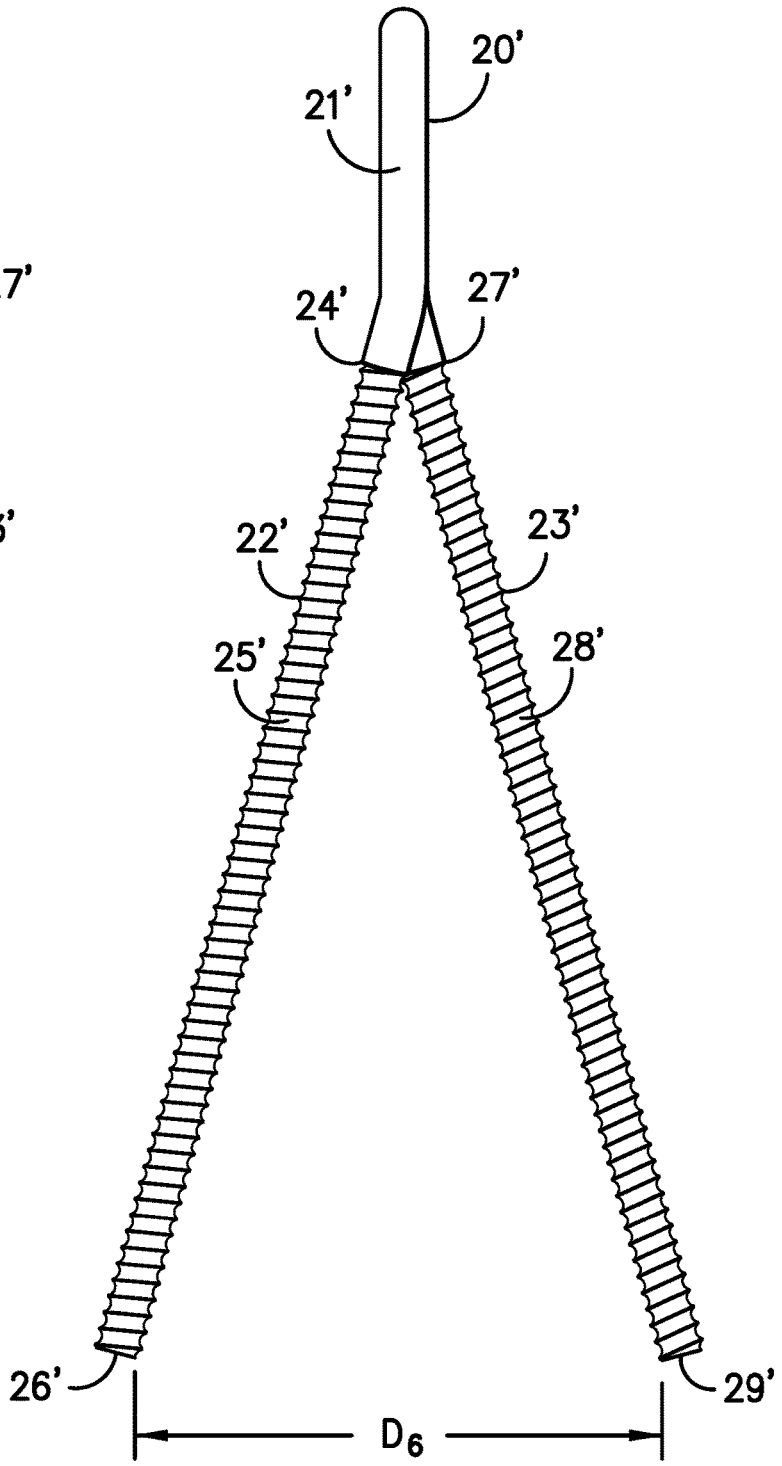
FIG. 4B is a side view of the anchor shown in FIG. 4A.

With regard to anchor 20 illustrated in FIGS. 3A and 3B, handle 21, leg 22 and leg 23 all lie in the same plane. Also within the scope of the present invention is for the legs of the anchor to converge with regard to a central plane, such as an imaginary plane perpendicular to handle 21, yet the legs may diverge relative to a plane aligned parallel to the handle, as shown in FIGS. 4A and 4B. In other words, the distance between the bottom ends of the legs, $D_6$, may be greater than the distance between the top ends of the legs, $D_5$, because the legs are not in the same plane as the handle. By way of example, distance $D_6$ may be 150% or more or even 200% or more than distance $D_5$.

Referring to FIGS. 4A and 4B, anchor 20' has handle 21' and legs 22' and 23' extending downward from handle 2'. Leg 22' has top end 24', threads 25' and bottom end 26'. Similarly, leg 23' has top end 27', threads 28' and bottom end 29'. The threads may have the same features and parameters as those described with regard to anchor 1 of FIG. 1.

Figure 5:
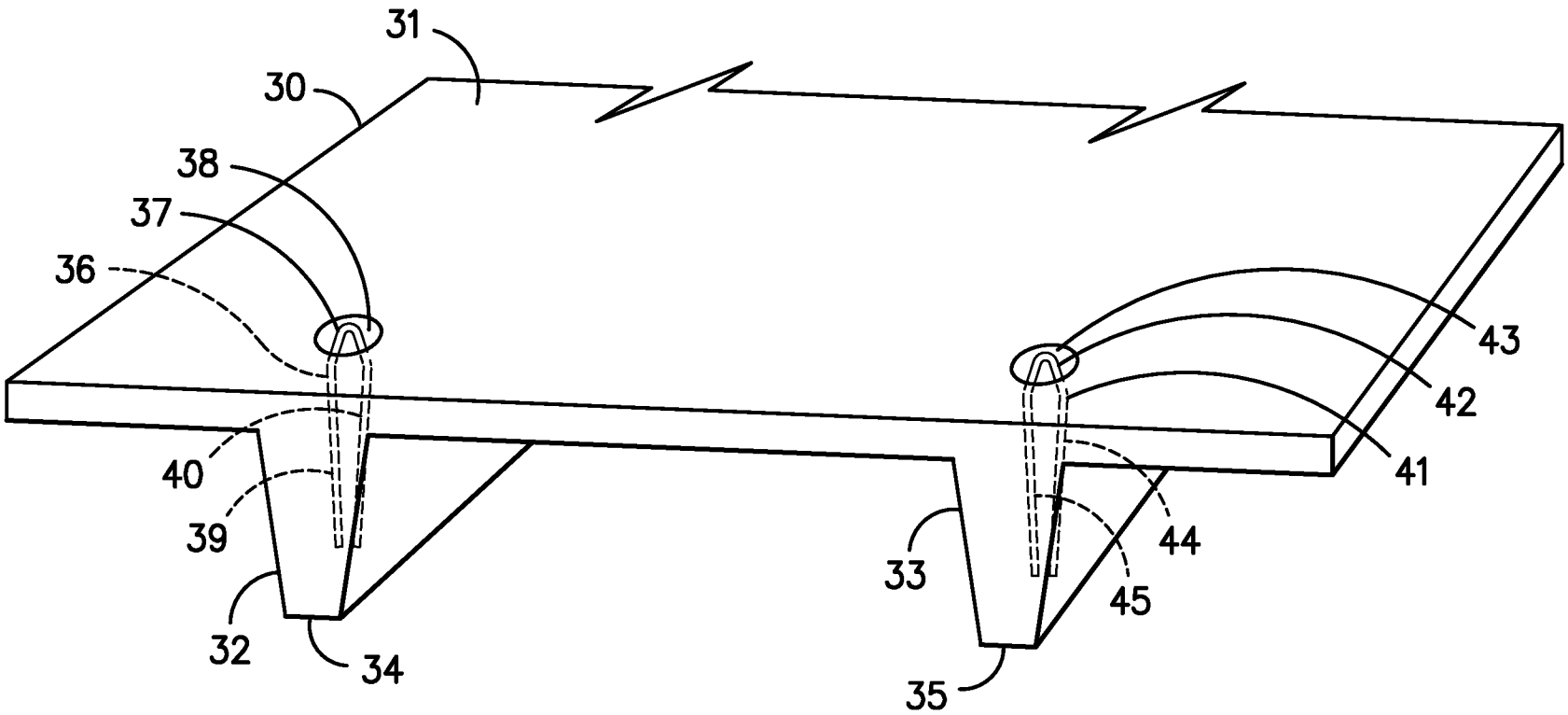
FIG. 5 is a perspective view of a precast concrete double tee having two anchors embedded therein.

Referring to FIG. 5, precast concrete double tee 30 has flange 31, and webs 32 and 33 extending perpendicularly and along the length of flange 31. Each of webs 32 and 33 taper from flange 31 to their respective bottom edges 34 and 35. Anchor 36 is embedded in double tee 30, with handle 37 positioned in recess 38 formed in flange 31, and legs 39 and 40 embedded in flange 31 and web 34. Similarly, anchor 41 is embedded in double tee 30, with handle 42 positioned in recess 43 and legs 44 and 45 embedded in flange 31 and web 33. In the embodiment shown in FIG. 5, the respective legs of anchors 36 and 41 converge as the legs extend downward from the handles, as described with regard to anchor 20 in FIGS. 3 and 4. It can be understood that the reference plane defining the angle at which the legs converge can be an imaginary plane running parallel to and centered in the web.

One advantage of the legs converging inward is that a relatively thick region of concrete is interposed between tike bottom end of the leg and the outer surface of the web, thereby minimizing the chance of forcing a fracture in the surrounding concrete.

Figure 6C:
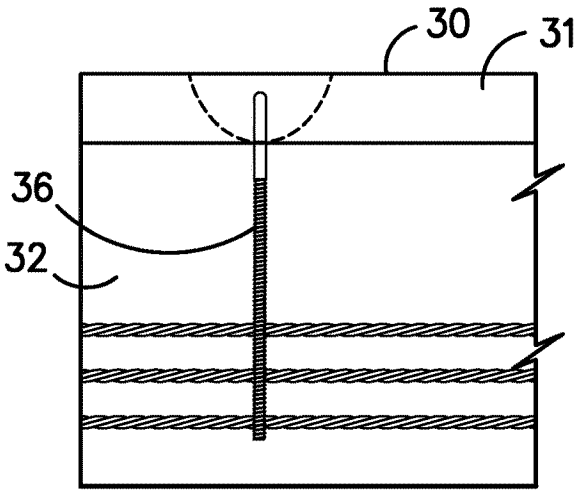
FIG. 6C is a side schematic view of the anchor of FIG. 5 in a double tee precast concrete component.
Figure 6B:
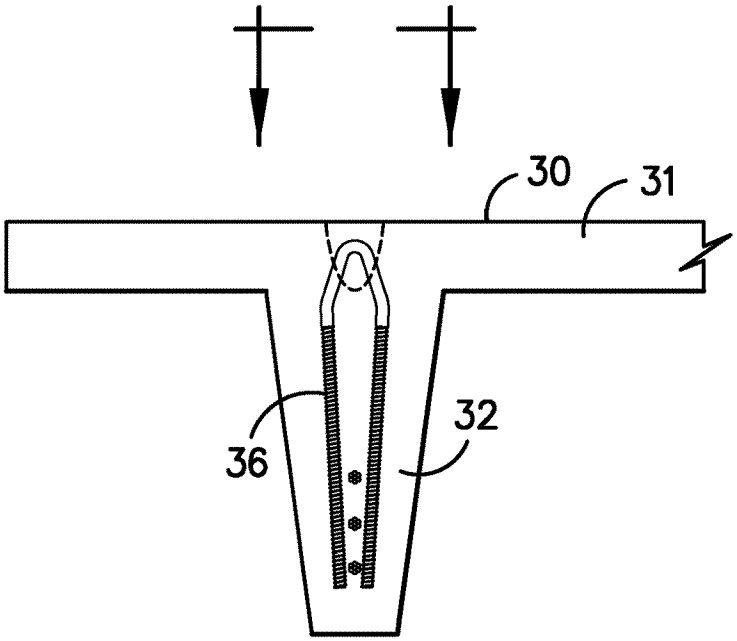
FIG. 6B is an end schematic view of the anchor of FIG. 5 in a double tee precast concrete component.
Figure 6A:
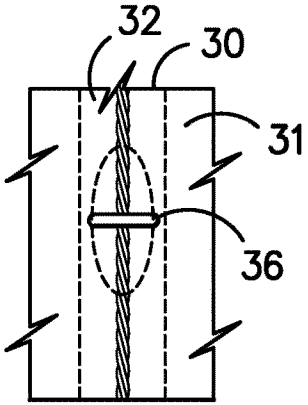
FIG. 6A is a top schematic view of the anchor of FIG. 5 in a double tee precast concrete component.

FIGS. 6A, 6B and 6C represent top, end and side schematic views, respectively, of the precast double tee of FIG. 5. Anchor 36 is aligned perpendicular to web 32 of double tee 30.

Figure 7C:
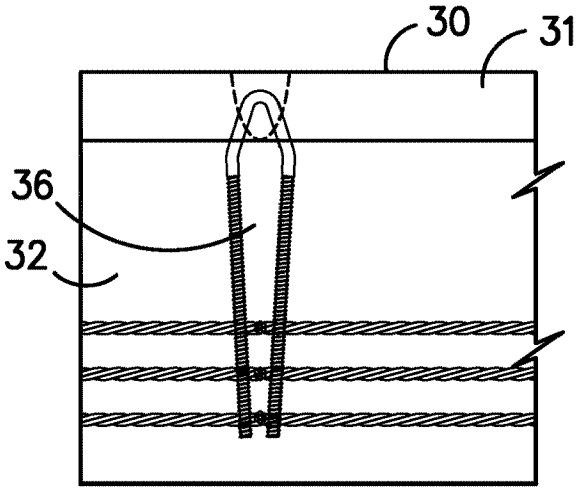
FIG. 7C is a side schematic view of an anchor in a double tee precast concrete component, wherein the anchor is parallel to the web.
Figure 7B:
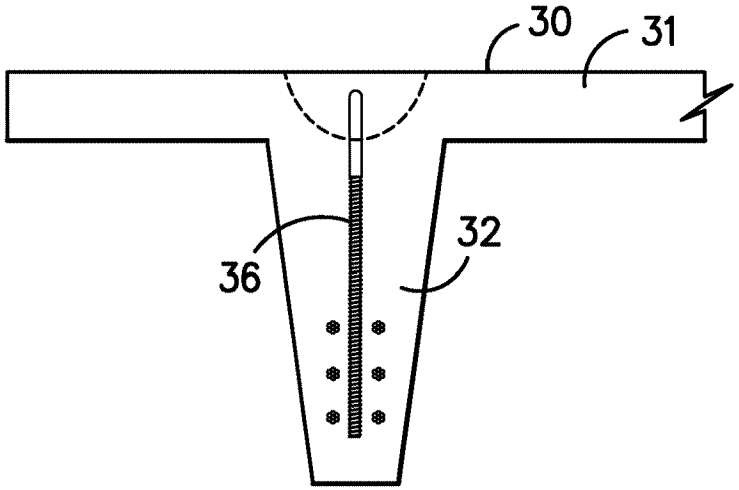
FIG. 7B is an end schematic view of an anchor in a double tee precast concrete component, wherein the anchor is parallel to the web.
Figure 7A:
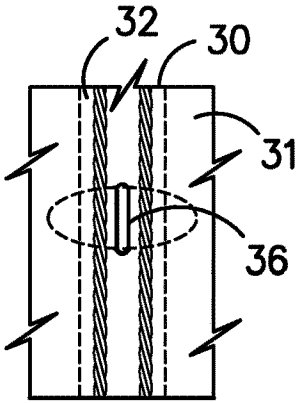
FIG. 7A is a top schematic view of an anchor in a double tee precast concrete component, wherein the anchor is parallel to the web.

FIGS. 7A, 7B and 7C represent top, end and side schematic views, respectively, of a precast double tee with the anchor aligned parallel to the web of the double tee. Anchor 36' has the same configuration and features as anchor 36 in FIG. 5. Anchor 36' lies in a plane parallel to the longitudinal extent of web 32' of double tee 30'.

Figure 8C:
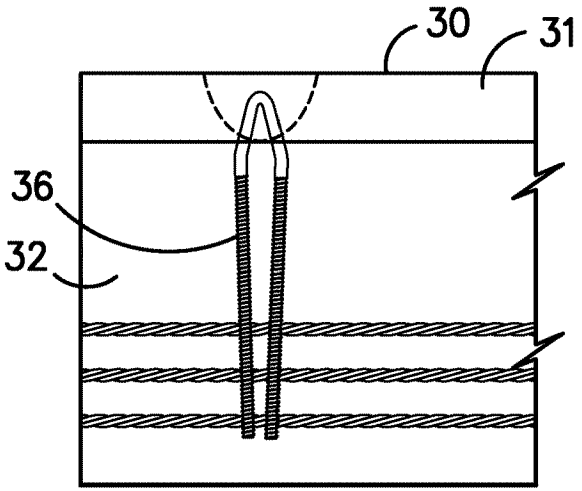
FIG. 8C is a side schematic view of an anchor in a double tee precast concrete component, wherein the anchor is at an angle of 45° relative to the web.
Figure 8B:
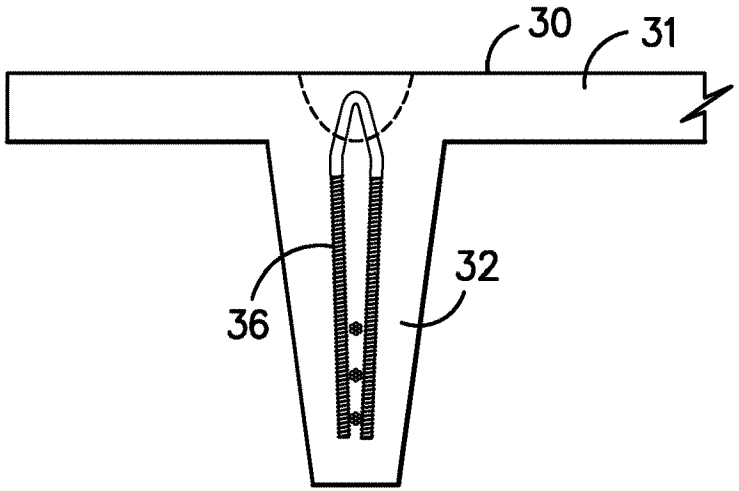
FIG. 8B is an end schematic view of an anchor in a double tee precast concrete component, wherein the anchor is at an angle of 45° relative to the web.
Figure 8A:
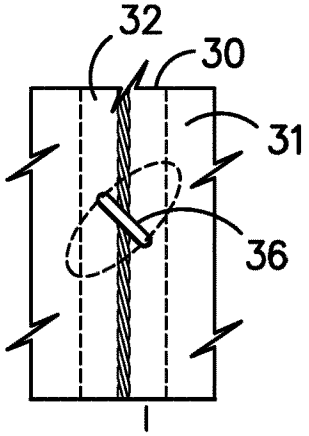
FIG. 8A is a top schematic view of an anchor in a double tee precast concrete component, wherein the anchor is at an angle of 45° relative to the web.

FIGS. 8A, 8B and 8C represent top, end and side schematic views, respectively, of a precast double tee with the anchor turned approximately 45° relative to the longitudinal extent of the web. Anchor 36" has the same configuration and features as anchor 36. Thus, anchor 36" is skewed relative to web 32" of double tee 30".

Figure 9:
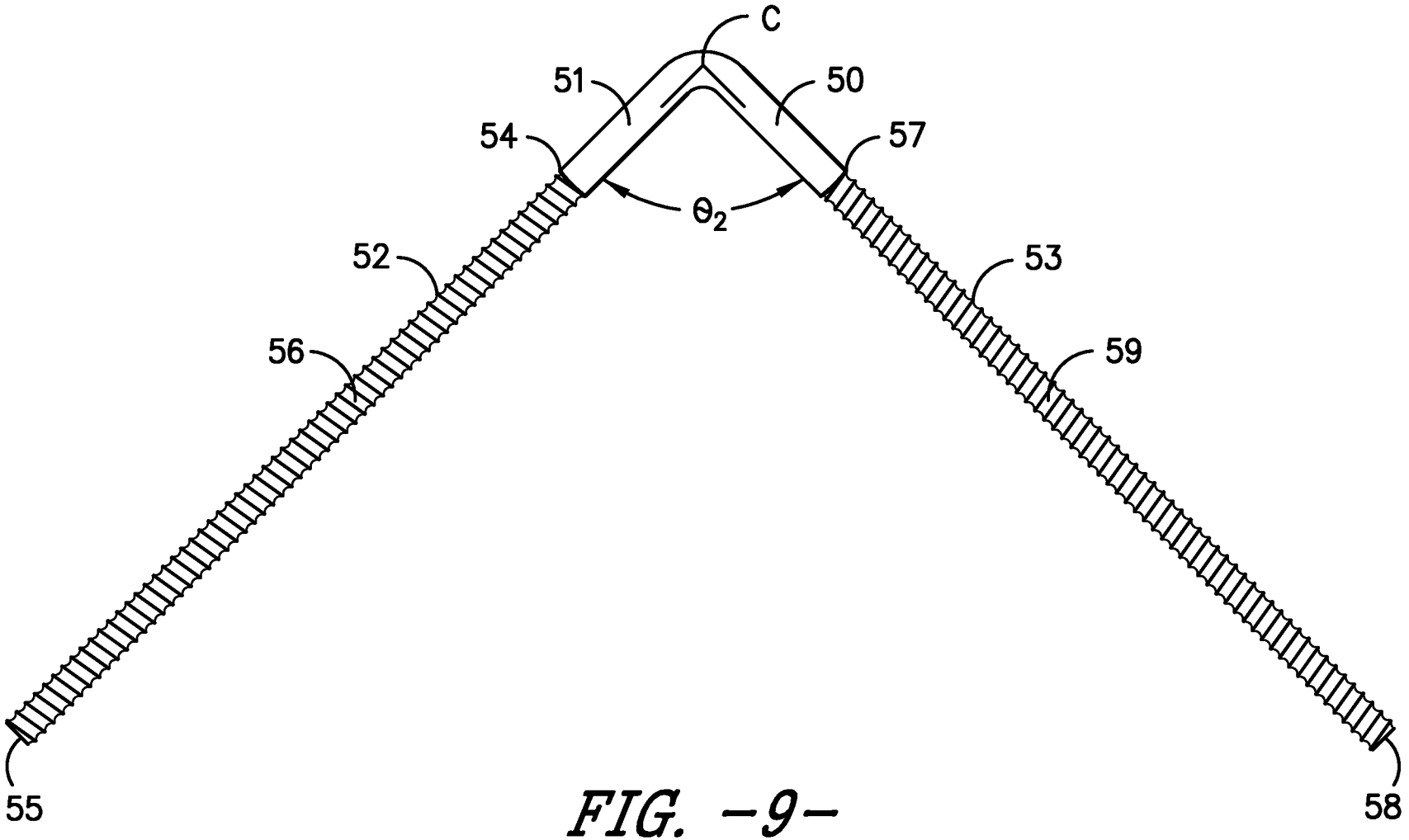
FIG. 9 is a side view of an anchor with legs that diverge from each other as they extend from the handle.

FIG. 9 illustrates an alternative embodiment of the anchor of the invention in which the legs of the anchor diverge as they extend from the handle. Anchor 50 has handle 51 centrally located between downwardly extending legs 52 and 53. Leg 52 has top end 54 adjacent handle 51, bottom end 55 opposite handle 51 and threads 56 in between. Leg 53 has top end 57 adjacent handle 51, bottom end 58 opposite handle 51 and threads 59 in between. The angles at which legs 52 and 53 diverge relative to an imaginary apex "C" is shown as angle $\Theta_2$, which, by way of example, may be greater than 0° up to 120°, in particular from 5° to 90°, more particularly from 10° to 75°. The divergence of legs 52 and 53 as they extend from handle 51 may also be characterized as the distance between the bottom end of the first leg and the bottom end of the second leg being at least two times greater, in particular at least five times greater or even at least 10 times greater than a distance between the top end of the first leg and the top end of the second leg. Anchor 50 may also be embedded in the web of a double tee precast concrete component, with the anchor oriented parallel to the longitudinal extent of the web.

An advantage of the legs converging inward or diverging outward is that a lateral force is exerted by the legs of the anchor against the concrete when the precast concrete component is lifted, thereby increasing the pull-out strength.

Figure 13:
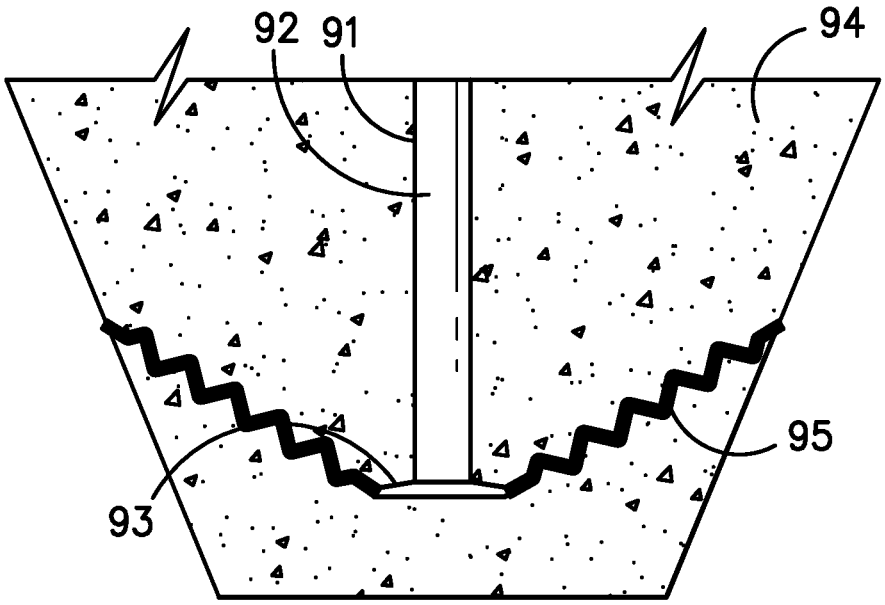
FIG. 13 is a side schematic view of a prior art lift anchor in a precast concrete component.
Figure 14:
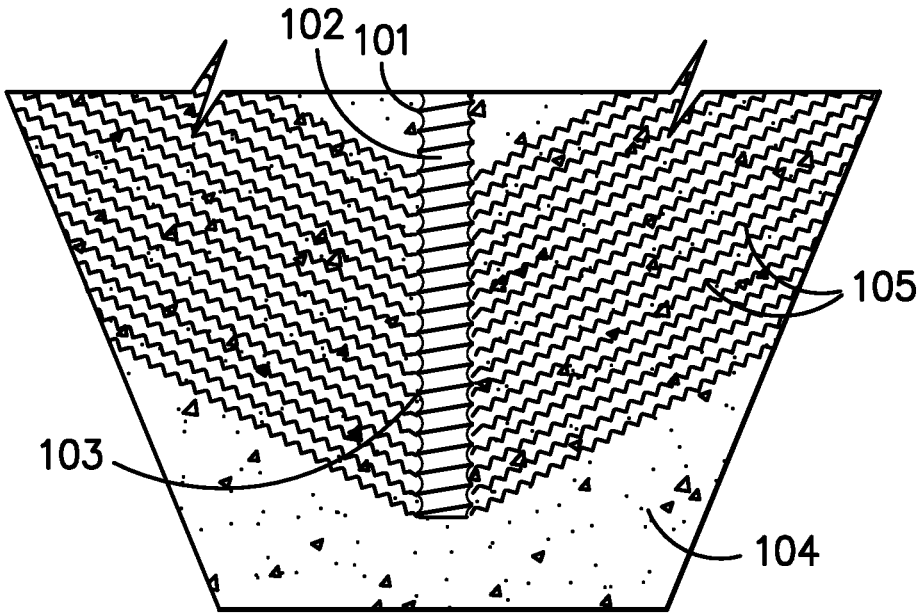
FIG. 14 is a side schematic view of a lift anchor of the present invention in a precast concrete component.

The distribution of stress forces in a representative prior art lift anchor and the lift anchor of the present invention is illustrated schematically in FIGS. 13 and 14, respectively. Referring to FIG. 13, prior art lift anchor 91 has leg 92 with flange 93 embedded in web 94. Stress line 95 illustrates the concentration of force acting on web 94 emanating from flange 93. Referring to FIG. 14, lift anchor 101 has leg 102 with a series of projections represented by threads 103 embedded in web 104. Stress lines 105 illustrate the forces acting on web 104 as emanating from and distributed along threads 103 of leg 102.

Referring to FIG. 10, the anchor shown in FIG. 1 is provided with nuts, to increase the pull-out strength of the anchor. Anchor 1 has legs 3 and 4, with threaded sections 6 and 9, respectively. Nut 61 is threaded onto leg 3, adjacent bottom end 7, and nut 62 is threaded on leg 4, adjacent bottom end 10. Referring to FIG. 11, the anchor shown in FIG. 1 is provided with nuts 71 and 72, threaded approximately midway up legs 3 and 4, respectively. Referring to FIG. 12, the anchor shown in FIG. 1 is provided with multiple nuts threaded onto each leg. Nut 81 is threaded midway up leg 3 and nut 82 is threaded adjacent bottom end 7 of leg 3. Similarly, nut 83 is threaded midway up leg 4 and nut 84 is threaded adjacent bottom end 10 of leg 4. The nuts may be held in place prior to embedding the anchor in concrete by application of an adhesive, such as a hot-melt adhesive, at the interface of the nut and leg.

FIGS. 6A-6C, 7A-7C and 8A-8C are illustrated with an anchor, such as the one disclosed in FIGS. 3A-3B. Nevertheless, the anchors disclosed in FIGS. 1,4A-4B, and 9-12 may also be embedded in die web of a double tee precast structure, provided the anchor can be oriented to allow sufficient space between the outer surface of the structure and the legs of the anchor.

In addition to double tees, the lift anchor of the present invention may be embedded in other precast structures, such as wall panels, columns, floors, beams, girders, slabs, bridges, walkways, steps, retaining walls, culverts, troughs, catch basins and concrete barriers.

There are, of course, many alternative embodiments and modifications, which are intended to be included within the following claims.

What I claim is:

1. An anchor for lifting a precast concrete component, comprising a cylindrical rod bent to form a centrally-positioned curved handle with first and second leas extending downward from the handle, wherein the handle is smooth, wherein the first leg is characterized by a top end adjacent the handle and a bottom end opposite the handle and threads are provided along a length of the first leg a distance of 6 inches or greater, and wherein second leg is characterized by a top end adjacent the handle and a bottom end opposite the handle and threads are provided along a length of the second leg a distance of 6 inches or greater, wherein the threads along the first and second legs are coil threads having a pitch of from 7 mm to 30 mm and a threadform characterized by adjacent crests and a concave arc extending between the adjacent crests.

2. The anchor of claim 1, wherein each of the first and second leas are straight and converge towards each other as they extend downward from the handle.

3. The anchor of claim 1, wherein a distance between the bottom end of the first leg and the bottom end of the second leg is 25% or less than a distance between the top end of the first leg and the top end of the second leg.

4. The anchor of claim 1, wherein the first and second legs angle inward from their top ends to their bottom ends at an angle of from 1° to 30°.

5. The anchor of claim 1, wherein the handle, first leg and second leg lie in the same plane.

6. The anchor of claim 1, wherein the threads of the first leg and the second leg are rolled threads characterized by a radius of from 7 mm to 14 mm.

7. The anchor of claim 6, wherein the threads of the first leg and second leg each extend a distance of 10 inches or greater.

8. The anchor of claim 1, wherein each of the first and second legs are straight and diverge away from each other as they extend downward from the handle.

9. The anchor of claim 1, wherein a distance between the bottom end of the first leg and the bottom end of the second leg is at least five times greater than a distance between the top end of the first leg and the top end of the second leg.

10. The anchor of claim 1, wherein first and second leg diverge as they extend downward from the handle an angle of from 5° to 90°.

11. The anchor of claim 1, wherein the threads of the first leg and the second leg are rolled threads having a pitch of from 10 mm to 20 mm.

12. An article, comprising:

(a) a precast concrete component; and (b) an anchor comprising a cylindrical rod bent to form (i) a centrally-positioned curved handle protruding from the concrete component, wherein the handle is smooth, and (ii) with first and second legs extending downward from the handle and embedded in the concrete component, wherein the first leg is characterized by a top end adjacent the handle and a bottom end opposite the handle and threads are provided along a length of the first leg, a distance of 6 inches or greater, and wherein the second leg is characterized by a top end adjacent the handle and a bottom end opposite the handle and threads are provided along a length of the second leg a distance of 6 inches or greater, wherein the threads along the first and second legs are coil threads having have a pitch of from 7 mm to 30 mm and a threadform characterized by adjacent crests and a concave arc extending between the adjacent crests.

13. The article of claim 12, wherein the first and second legs angle inward from their top ends to their bottom ends at an angle of from 1° to 45°.

14. The article of claim 12, wherein the first and second legs angle outward from their top ends to their bottom ends at an angle of from 5° to 90°.

15. The article of claim 12, wherein the precast concrete component comprises a planar flange with a recess therein and at least one web extending perpendicularly from the flange, and wherein the handle of the anchor is positioned in the recess in the flange and wherein the first and second legs of the anchor extend into the web, and wherein the threads of the first leg and second leg each extend a distance of 10 inches or greater.

16. The article of claim 12, wherein the web tapers as it extends from the flange of the concrete component, and wherein each of the first and second legs are straight and converge towards each other as they extend downward from the handle.

17. The article of claim 16, wherein the concrete component is a double tee, and wherein the threads of the first leg and second leg each extend a distance of 15 inches or greater.

18. The article of claim 12, wherein each of the first and second legs are straight and diverge away from each other as they extend downward from the handle.

19. The article of claim 12, wherein the threads of the first leg and the second leg are rolled threads characterized by a radius between adjacent crests of the threads of from 7 mm to 14 mm.

20. The article of claim 12, wherein the threads of the first leg and the second leg are rolled threads having a pitch of from 10 mm to 20 mm.

* * * * *